United States Patent [19]

Takano et al.

[11] Patent Number: 4,888,461

[45] Date of Patent: Dec. 19, 1989

[54] HIGH-FREQUENCY HEATING APPARATUS

[75] Inventors: Teruhisa Takano, Osaka; Hitoshi Kurita, Yamatokoriyama; Yasuteru Fujii, Gojo; Haruo Suenaga, Soraku; Masashi Yano, Kashihara, all of Japan

[73] Assignee: Matsushita Electric Industrial Co., Ltd., Osaka, Japan

[21] Appl. No.: 153,411

[22] Filed: Feb. 8, 1988

[30] Foreign Application Priority Data

| | | | |
|---|---|---|---|
| Feb. 10, 1987 | [JP] | Japan | 62-27409 |
| Feb. 10, 1987 | [JP] | Japan | 62-27410 |
| Feb. 10, 1987 | [JP] | Japan | 62-27411 |
| Feb. 20, 1987 | [JP] | Japan | 62-38406 |
| Mar. 5, 1987 | [JP] | Japan | 62-50504 |
| Mar. 9, 1987 | [JP] | Japan | 62-53311 |
| Mar. 13, 1987 | [JP] | Japan | 62-59376 |

[51] Int. Cl.[4] ..... H05B 9/06

[52] U.S. Cl. ..... 219/10.55 B; 219/10.55 R; 363/55; 307/43; 336/180

[58] Field of Search ..... 219/10.55 B, 10.55 R, 219/10.77; 331/114; 315/105, 106; 363/20, 21, 55; 336/180, 182, 170; 323/908; 364/477; 307/43, 85

[56] References Cited

U.S. PATENT DOCUMENTS

| | | | |
|---|---|---|---|
| 2,668,911 | 2/1954 | Schlesinger | 336/170 X |
| 3,241,048 | 3/1966 | Lee | 336/182 X |
| 3,816,688 | 6/1974 | Fritts | 219/10.55 B |
| 3,973,165 | 8/1976 | Hester | 315/105 |
| 4,002,875 | 1/1977 | Kiuchi et al. | 219/10.55 B |
| 4,142,082 | 2/1979 | Israel | 219/10.55 B |
| 4,317,976 | 3/1982 | Noda | 219/10.55 B |
| 4,441,002 | 4/1984 | Teich et al. | 219/10.55 B |
| 4,617,438 | 10/1986 | Nakata | 219/10.55 B |
| 4,675,796 | 6/1987 | Gautherin et al. | 363/20 |
| 4,697,229 | 9/1987 | Davy et al. | 363/49 |
| 4,725,948 | 2/1988 | Mierzwinski | 364/400 |

FOREIGN PATENT DOCUMENTS 3236290 4/1984 Fed. Rep. of Germany .

OTHER PUBLICATIONS

Japanese Abstracts for Patent Applications: 50-155584, 51-21505, 51-138144.

*Primary Examiner*—A. D. Pellinen
*Assistant Examiner*—David Osborn
*Attorney, Agent, or Firm*—Wenderoth, Lind & Ponack

[57] ABSTRACT

A high frequency heating apparatus includes an inverter controlling circuit for controlling a semiconductor portion for feeding a low voltage power supply switching element, a low voltage power supply to the controlling circuit, an operation switch for activating the apparatus by a user, and a system controlling portion for controlling a load switching device. The load switching device is adapted to switch on and off at least one of the low voltage power supply leading to the inverter controlling circuit and a rectification circuit.

8 Claims, 9 Drawing Sheets

HIGH-FREQUENCY HEATING APPARATUS

BACKGROUND OF THE INVENTION

The present invention relates to a high frequency heating apparatus using an inverter power-supply in a high tension generating circuit for magnetron driving use, and more particularly to a high-frequency heating apparatus provided with interfaces of both an inverter controlling portion for directly controlling the inverter and a system controlling portion for controlling a heater, an indicator and the like.

Generally, as a result of the recent significant developments in the semiconductor arts and controlling arts, inverter power-supplies are designed having outputs of higher voltages and electric power, especially in the employment of the higher power requirements of semiconductor switching elements.

The inverter power-supplies are being applied in many fields due to the following characteristics:

(1) the power supplies may be made smaller in size and lighter in weight, (2) the output may be readily varied, (3) the corresponding operation may be effected without exchanging parts with respect to either of the commercial 50 Hz, 60 Hz AC power source a DC power source such as a DC battery in the input power-supply frequency.

(4) the corresponding operation may be effected with respect to a wider input voltage range, so that it may be effected to 100 V through 200 V in input voltage, to as far as 220 V as the case may be, thus allowing the common use.

As all of the above described effects may be achieved through the use of the inverter power-supply for the magnetron driving power-supply in a high frequency heater using the magnetron, the inverter power-supply may be used more and more in the future.

When the inverter power-supply is used as a magnetron driving power-supply, a high voltage of approximately 4 KV and a high power output of approximately 1 KW are required to be fed to the magnetron. A large task in the designing of such an inverter power-supply as described hereinabove is to protect the semiconductor switching elements from an excessive voltage and excessive current. As in the case of a resonance type inverter using a capacitor, a short-circuit current for charging the capacitor flows to the semiconductor switching element, and expecially during the initial driving operation, it is required to protect the semiconductor switching elements from the short-circuit current. This is called a soft start, and this controlling operation is required to be effected until the above described capacitor is charged. Generally, the timer circuit is used, but the problem in this case is that of the timer accuracy, and a so-called momentary power-off detecting function is required for detecting whether or not the capacitor has electrically been discharged by the momentary power-off.

Another problem unique to driving the magnetron is that the magnetron has a heater, and the high current of the magentron does not flow during a period (for a few seconds) before the heater is sufficiently heated. Accordingly, during this period, the semiconductor switching elements are required to be protected, because they are exposed and can be overloaded. Conventionally, a CR timer is used for protection. Even in this case, both the accuracy of the CR timer and a circuit for resetting the CR timer are required.

Namely, the following functions are required.

(1) a first soft start function for protecting the semiconductor switching elements from the overload, which is caused by the charging current of the capacitor, and (2) a second soft start function for protecting the semiconductor switching elements from the overlaod at the magnetron rising time.

The first soft start is required during the resetting, several milliseconds after the power off, called momentary power-off, with the latter being unnecessary when the power off is within approximately several hundred millisecond to one second because of remaianing heat of the heater. It is necessary to realize these functions with better accuracy in a simple construction.

a system controlling portion is required to heat the high frequency heating apparatus for a given time period and to display that it is being heated. Such a system controlling portion as described is conventionally composed of a digital circuit using a microcomputer. As this system controlling portion is provided with keyboards to be operated by the user, display portion provided on the operation panel surface, and so on, the service power-supply into the system controlling portion is insulated from the commercial power-supply using an transformer so as to prevent users from any possible risk of being electrified.

The above described inverter controlling circuit has a service power-supply connected to the commercial power-supply so as to drive the semiconductor switching elements connected with the commercial power-supply line.

The inverter controlling circuit has as a danger the possible electrification of the user should he or she touch it. Thus, if the system controlling portion is directly connected with the inverter controlling circuit, such danger cannot be prevented.

In order to provide a high frequency heating apparatus having the above described inverter controlling circuit and the above described system controlling portion at a lower cost, it is necessary to reduce the number of components to a minimum and to simplify the circuit. For example, it is necessary to commonly use, for instance, a door opening and opening detecting means for detecting whether or not the door of the heating chamber is open in both the inverter controlling circuit and the system controlling portion.

As described hereinabove, the following features have to be developed, (1) a timer and momentary power-off detecting function for protection against overload, (2) a power supply construction which may prevent the user from the danger of being electrified, (3) the common use of the door opening and closing detection function, and so on.

SUMMARY OF THE INVENTION

Accordingly, an essential object of the present invention is to provide an improved high frequency heating apparatus which is realized by a more precise and simpler construction through the digital controlling operation with a momentary power-off detecting function and a start beginning time controlling function so as to protect the semiconductor switching elements from being overloaded at the starting time.

Another important object of the present invention is to provide a high frequency heating apparatus which has a feeding construction capable of protecting the user from being electrically shocked in the feeding construction of the inverter controlling circuit and the system controlling portion.

A further object of the present invention is to provide a high frequency heating apparatus which has an improved door opening and closing detection means of the heating chamber through the simplification of the entire circuit construction.

BRIEF DESCRIPTION OF THE DRAWINGS

These and other objects and features of the present invention will become apparent from the following description taken in conjunction with preferred embodiments with reference to the accompanying drawings, in which:

FIG. 3-1 is a flowchart showing one embodiment of the power-off detecting means in accordance with the present invention;

FIG. 3-2 is a flowchart showing one embodiment of a stop-time detecting means and a start signal outputting means in accordance with the present invention;

DETAILED DESCRIPTION OF THE INVENTION

Figure 1:
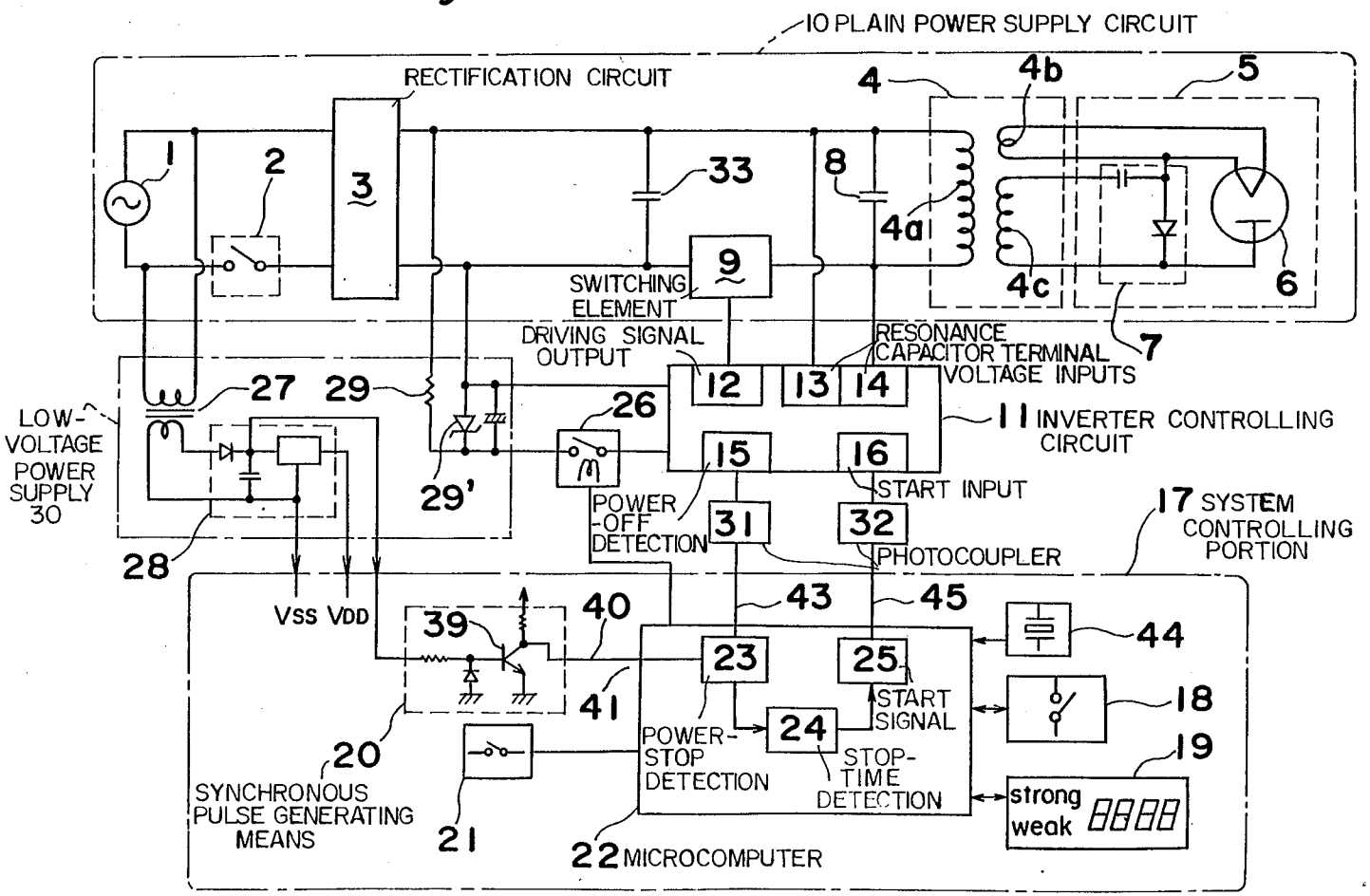
FIG. 1 is a circuit diagram showing an essential portion of a high frequency heating apparatus according to one preferred embodiment of the present invention.

Before the description of the present invention proceeds, it is to be noted that like parts are designated by like reference numerals throughout the accompanying drawings.

Referring now to the drawings, there is shown in FIG. 1 a circuit diagram showing an essential portion of a high frequency heating apparatus according to one preferred embodiment of the present invention, which includes a commercial power-supply 1 which is connected with AC 120 V, 60 Hz, AC 100 V, 50 Hz or the like, a door switch 2 which operatively cooperates with the selective opening and closing operations of the heating chamber door of the high frequency heating apparatus, a rectification circuit 3 for rectifying the commercial power-supply, a high frequency transformer 4 having a primary winding 4*a*, secondary windings 4*b* and 4*c*, a high frequency oscillator 5, a magnetron 6 and a voltage doubling circuit 7. Resonance capacitors 8 are connected in parallel to the primary winding 4*a* of the high frequency transformer to construct a resonance circuit. A semiconductor switching element 9 is desired to be a semiconductor element for high-speed, high-power switching use including an inverse conductive diode therein. A main power supply circuit 10 is composed of a commercial power supply 1 through a semiconductor switching element 9. An inverter controlling circuit 11 has a driving signal output portion 12, a resonance capacitor terminal voltage input portions 13 and 14 therein, which are described in detail later. They are respectively connected with the gate of the semiconductor switching element 9, with both ends across the resonance capacitor. Also, the inverter controlling circuit 11 has a power-off detection inputting portion 15 and a start inputting portion 16. Signals are inputted into these input portions to respectively effect the soft start controlling operation as described later. A system controlling portion 17 has therein an operation switch 18, a display means 19, a snychronous pulse generating means 20 for generating pulses synchronized with the commercial power supply, a door opening and closing detection means 21 composed of a door switch or the like which is adapted to open or close through the operative cooperation with the door switch 2, a microcomputer 22, a power-off detecting means 23, a stop-time detecting means 24, a start signal outputting means 25 and a controlling portion opening and closing means 26 which is adapted to open or close the feeding of the low voltage power to the inverter controlling circuit 11. A low voltage power-supply portion 30 is adapted to feed low voltage power to the inverter controlling circuit 11 and the system controlling portion 17. The low voltage transformer 27 is connected on its primary side with the commercial power supply, and is connected on its secondary side with a known DC constant circuit 28 to feed the output to the system controlling portion. The power supply of the inverter controlling circuit is fed, with the output of the rectification circuit 3 being dropped in voltage and made constant in voltage by a resistor 29 and a Zener diode 29' for the feeding operation.

A first coupling means 31 couples the power-off detection inputting portion 15 to the output of the power-stop detecting means 23, through the retention of the insulation, and is composed of a photocoupler, etc.

A second coupling means 32 couples the start inputting portion 16 to the start signal output means through the retention of the insulation, and is composed of a photocoupler, etc. as is the case with the first coupling means 31.

An inverter boosting system constructing the main power supply portion will be briefly described. The semiconductor switching element is turned on and off to supply a high frequency current to the primary winding 4*a* of the capacitor the high frequency transformer and resonance to effect the boosting operation through the transformer in high frequency range of 20 KHz to 40 KHz. In the steady-state condition, the output of the inverter power supply is controlled by the conduction time of the semiconductor switching element.

The problem is that controlling in the two-non-steady state conditions, i.e. the period from the start of switching of the semiconductor switching element 9 to the steady-state condition and the period ot the start of oscillation upon the application of the voltage upon the high frequency oscillator 5.

When the switching operation of the semiconductor switching element 9 starts for the first time, the electric charge of the resonance capacitor 8 is empty at this time. Accordingly, when the semiconductor switching element is turned on, the short-circuit current for charging the resonance capacitor 8 flows to the semiconductor switching element 9, so that there is a danger of damaging the element. When a smoothing capacitor 33 is provided, the total electric charge stored in the smoothing capacitor is discharged, so that the possibility of damage become particularly large. Accordingly, during the period from the initial start to the steady-state condition, the on time of the semiconductor switching element 9 is required to be made shorter than the steady-state condition. We call this controlling operation a first soft start control. The first soft start control is required for the start when the resonance capacitor 8 is empty, i.e., at the start after the power off. Thus, the inverter controlling circuit 11 has a power-off detection inputting portion 15. When the power-off detection inputting portion 15 has inputs, the above described first soft start controlling operation is effected.

When the inverter circuit starts its operation to supply current to the coil 4*a*, a voltage is effected in the heater winding 4*b* to start the heating of the magnetron 6. The anode current does not flow, because the electron emission is not effected before the heater is heated to several thousand degrees. This period required several seconds. During this period, a coil 4*c* is is in approximately a no-load condition, so that the load of the inverter circuit becomes also small. When the semiconductor switching element 9 is controlled at such a period as described hereinabove for the on time period as is the case during the steady-state condition, the output becomes excessive, so that the overlaod is given to a component such as semiconductor switching element 9, high frequency transformer 24 or the like. Accordingly, during a period in which the heater of the magnetron is sufficiently heated, such controlling operation to repress the output as in the above described first soft start is required. We call this a second soft start. The inverter controlling circuit 11 has a start inputting portion 16 for the controlling operation. While the inputs are given to the start inputting portion 16, the second soft start controlling operation is adapted to be effected.

In order to effect the two soft start controlling operations, it is required to form signals which are given to the respective inputs 15 and 16.

Figure 2:
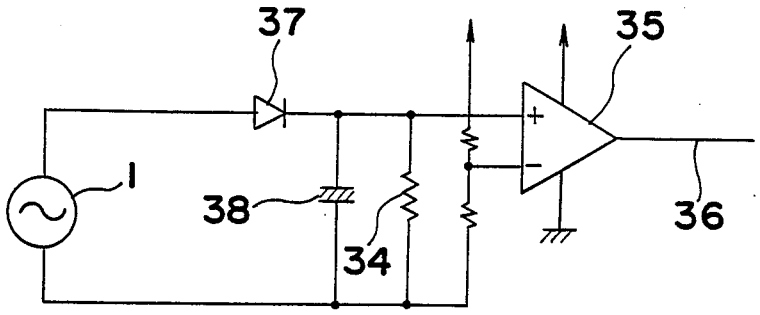
FIG. 2 shows a circuit diagram of a conventional power-off detecting means.

The power-off detecting means is required to detect the momentary power-off of a half a cycle to several tens of cycles in the commercial power supply. In the conventional embodiment, as shown in FIG. 2, the power-off of the conventional power supply 1 is detected by a capacitor 38 charged through a diode 35, a discharging circuit of a resistor 34, and a comparator 35. Namely, the output 36 of the comparator 35 is outputted high, while the commercial power-off 1 is fed. When the commercial power supply has stopped, the electric charge of the capacitor 38 is discharged by a discharge resistor 34. When it has become a given value or lower, the output 36 of the comparator 35 is reversed to show that the power-off had been effected.

However, it is desirable for the power-off detecting means to detect the break off of a half cycle to one cycle of the commercial power supply. But in the conventional embodiment shown in FIG. 2, it is difficult to detect such a break off as described hereinabove because of the varying factors, such as constant selection and accuracy of the capacitor 38, the discharging resistor 34, and the power supply voltage variation.

Also, it is necessary to detect whether or not the heater of the magnetron is cold in order to control the second soft start. This is effected by detecting to whether or not the inverter circuit has stopped for a given time, i.e., 0.5 second or more, through the time counting operation. However, two major factors for causing the stop operation of the inverter circuit are (1) the longer power-off of the commercial power supply, and (2) the stopping operation because of the unnecessary heating operation. Therefore, the inverter controlling circuit requires a detecting portion for the above described power-off, and a detecting portion for detecting that the operation has been stopped although the power-off is not effected. Accordingly, a timer is required for the two detections.

Figures 1, 3:
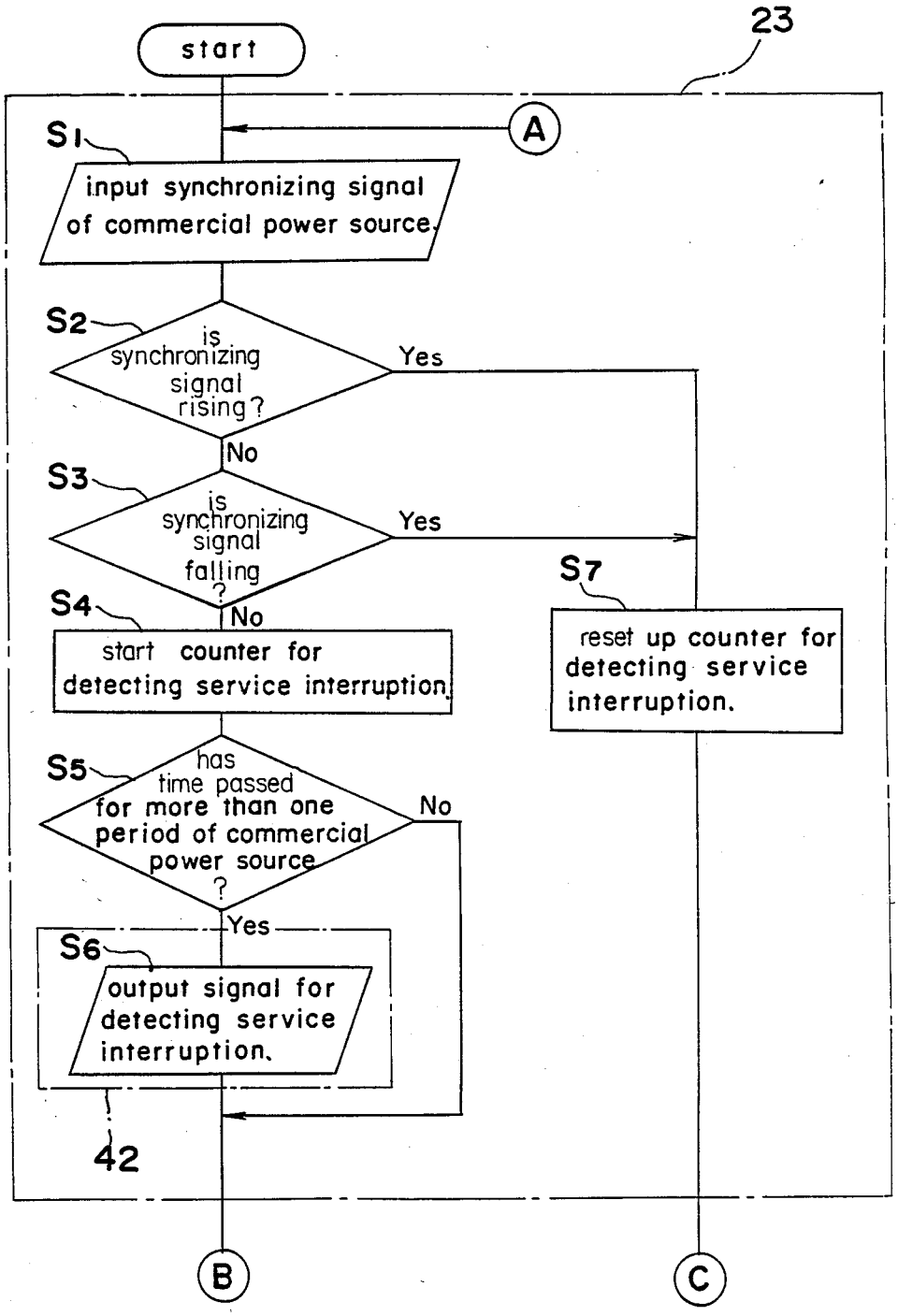
Figures 2, 3:
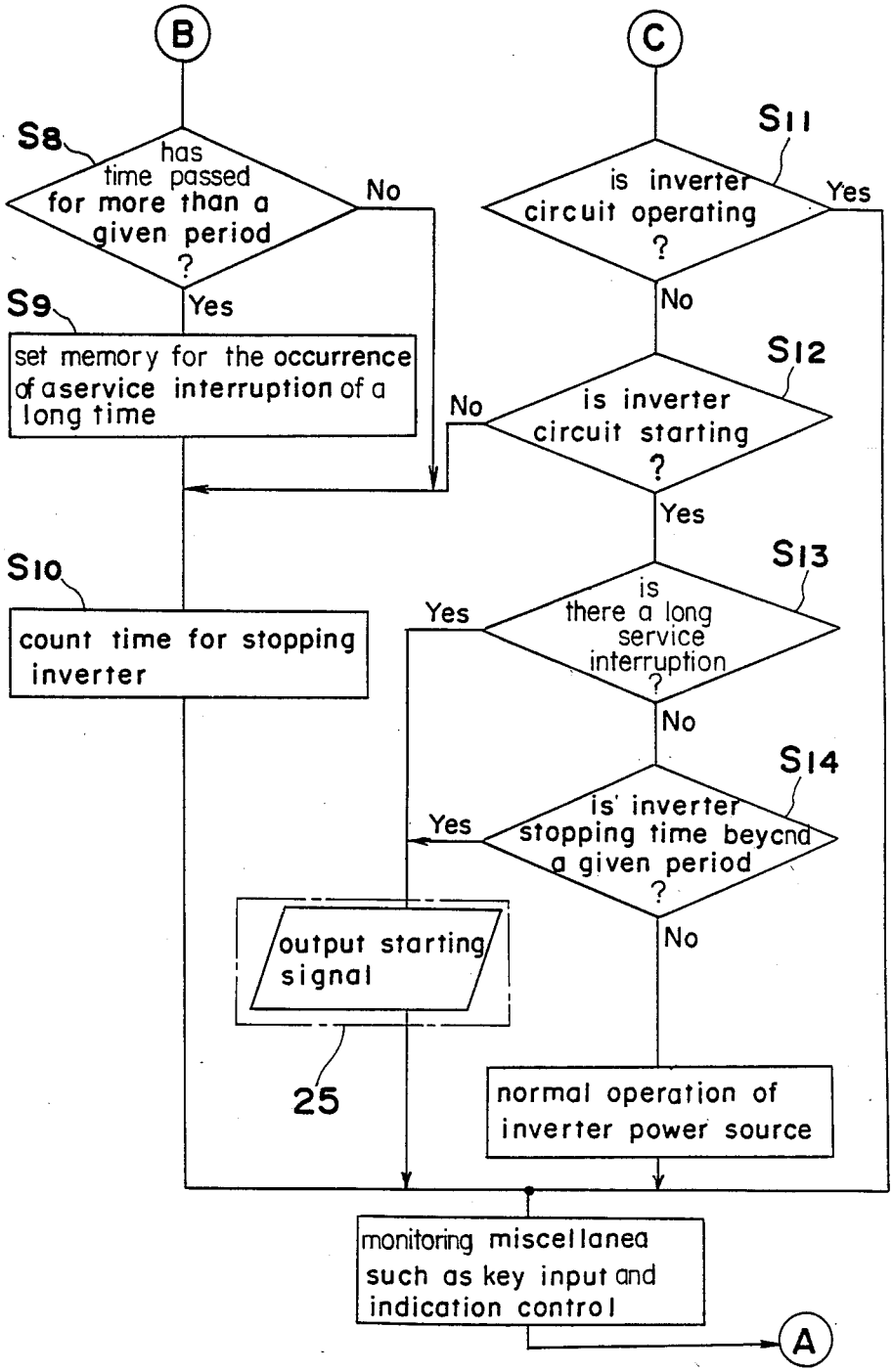

An embodiment which is free from the above described disadvantages in accordance with the present invention will be described hereinafter. In FIG. 1, as a dropped voltage of the commercial power supply is applied to the base of the transistor 39, pulses synchronized with the commercial power supply are effected on the synchronous signal line 40 connected with the collector which is connected with the synchronous signal input terminal 41 of the microcomputer 22. Accordingly, the program built in the microcomputer 22 detects whether or not the input terminal repeats the rising or falling at a period of the given time so as to detect the power-off of the commercial power supply. FIG. 3-1 and FIG. 3-2 show a flow chart in one embodiment of the present invention. FIG. 3-1 show a power-off detecting means 23.

Namely, in FIG. 3-1, the synchronizing signal of the commercial power supply is inputted (S1) to detect either the rising or falling of the commercial power supply (S2 of S3). When either of them does not detect the rising or falling of the synchronizing signal for a given time, i.e., before the value becomes the given one through the counting (S4) of the power-off detecting counter (S5), the power-off is detected (S6). At this time, the power-off detecting signal 43 is outputted in the power-off detecting output portion 42. The power-off detecting signal 43 is electricaly insulated through a photocoupler 31 and is inputted to an inverter controlling circuit 11 into the power-off detection inputting portion 15.

Thus, the power-off of one period or more of the commercial power supply may be correctly detected. The time counting at this time is effected by the power dividing of the frequency of a reference oscillating circuit 44 using the crystal of the microcomputer or the ceramics vibrator, or by the counting of the execution times of the order.

The step S7 does not mean the power-off, with the synchronous signals being inputted. Accordingly, the counter for power-off detection is cleared.

The stop time detecting means 24 detects the stop time of the inverter circuit as described hereinafter.

During the power-off, condition when the power-off condition has continued for the given time or more, the decision is effected as to whether or not the power-off of the time, for which the above described second soft start controlling operation has to be effected, continues (S8), the long power-off condition continued for the given time or more is memorized (S9).

Since the inverter cirucit is at a stop, the topping time is counted (S10).

When the current is flowing, it is determined whether or not the start of the inverter circuit is necessary at steps S11 and S12. The noticeable thing is that as the microcomputer 23 controls the operation switch and the display portion, it may be performed through the reference of all the inside memories whether the inverter circuit should be operated or stopped because of the reasons except for a power-off condition or whether or not it is at a stop. Accordingly, the detection in steps S13 and S14 may be effected simply through the reference of the inside memories, thus requiring no external components. A start signal outputting portion 25 outputs a starting signal which causes the inverter controlling circuit 11 to effect the second soft start controlling operation.

At step S13, the stop of the given time or more because of the power off is detected, and at step S14, stop because of any reason, except for the power off, is detected, with the starting signal 45 (See FIG. 1) being outputted by the start signal outputting portion 46 in either case, electric isolation being provided through the photocoupler 32 for coupling to the starting input 16 of the inverter controlling circuit 11.

Also, needless to say, the signals 43 and 45 are outputted even at the start time of the initial inverter circuit after the power supply of the microcomputer has been put to work.

As described hereinabove, according to the present invention, the output for the restarting signal after the stop has been provided within a system controlling portion for controlling the start, completion of the heating operation, the construction may be provided extremely simply even in the construction of the whole circuit and the program. Also, as the power-off detecting portion is provided within the system controlling portion, the construction is simple, because it may also serve as the counting of the heating time. As the inverter controlling circuit does not require a timer ranging to several seconds, it may be integrally circuited. Also, parts of much dispersion, such as capacitor or the like, are not required for the timer, so that the cost is lower, thus resulting in more practical usage.

The power supply construction of an inverter controlling circuit and a system controlling portion 17 with the insulation being taken into consideration will be described hereinafter.

Returning to FIG. 1, the inverter controlling circuit 11 is connected to drive the semiconductor switching element 9 connected without the insulation to the commercial power supply as described before. Likewise, in order to measure both the end voltages across the resonance capacitor 8, it is connected without the insulation to the commercial power supply. Thus, when the ordinary user touches the inverter controlling circuit, there is a danger of the user being electrified.

The system controlling portion 17 includes an operation switch 18, a displaying portion 19, and some other components accessible to the ordinary user. Although they are generally insulated from the charging portion of the system controlling portion through the mechanical insulating member, the operator may still in some circumstances come to touch it (for example, when the surface insulating sheet of the switch is broken). In order to prevent the danger of the electrification in such case a, the power supply to be fed to the system controlling portion must be insulated from the commercial power supply.

In FIG. 1 which is one embodiment in accordance with the present invention, the insulation between the system controlling portion 17 and the inverter controlling circuit 11, the major power supply circuit is retained by the controlling portion opening and closing means composed of the first and second coupling means 31 and 32 and a relay, and by the transformer 27.

Figure 4:
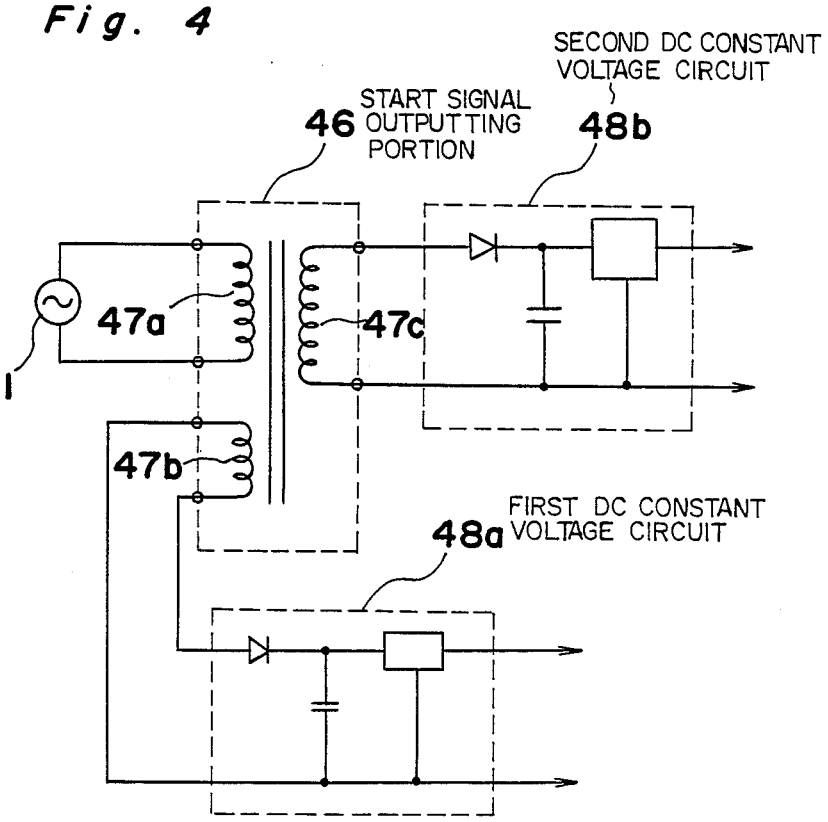
FIG. 4 is a circuit diagram showing one embodiment of low voltage transformer in accordance with the present invention.

A transformer is not used for the power supply into the inverter controlling circuit in the low voltage power supply portion in the embodiment of FIG. 1, but the other embodiment using the transformer will be described with reference to FIG. 4. A first primary winding connected with the commercial power supply, a second primary winding connected with the first DC constant voltage circuit 48*a* are provided on the primary side of the low voltage transformer 46, and the secondary winding 47*c* connected with the second DC constant voltage circuit 48*b* is provided on the secondary side. The output of the first constant voltge circuit 48*a* is connected with the inverter controlling circuit 11, the output of the second constant voltage circuit 48*b* is connected with the system controlling portion. The two primary windings do not require much insulation.

Figure 5:
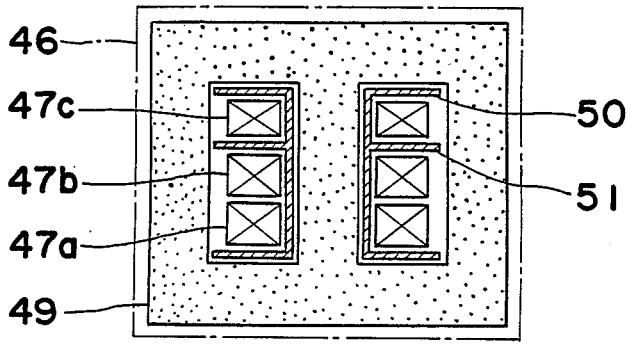
FIG. 5 is a cross sectional view of a portion in one embodiment of a low voltage transformer in accordance with the present invention.

The sectional view in one embodiment of the low tension transformer 46 is shown in FIG. 5. The insulation is provided between the first and second primary windings 47*a* and 47*b* and the secondary winding 47*c* by the insulating portion 51 between the primary and the secondary of the bobbin 50 provided within the core 49 as shown.

Also, the insulation construction of the low voltage transformer 46 is not restricted to the system shown in FIG. 5. The insulation may be provided between both the circuits even by a system of superposing and winding the primary and secondary windings to insulate the location between both the windings with the insulating paper.

Figure 6:
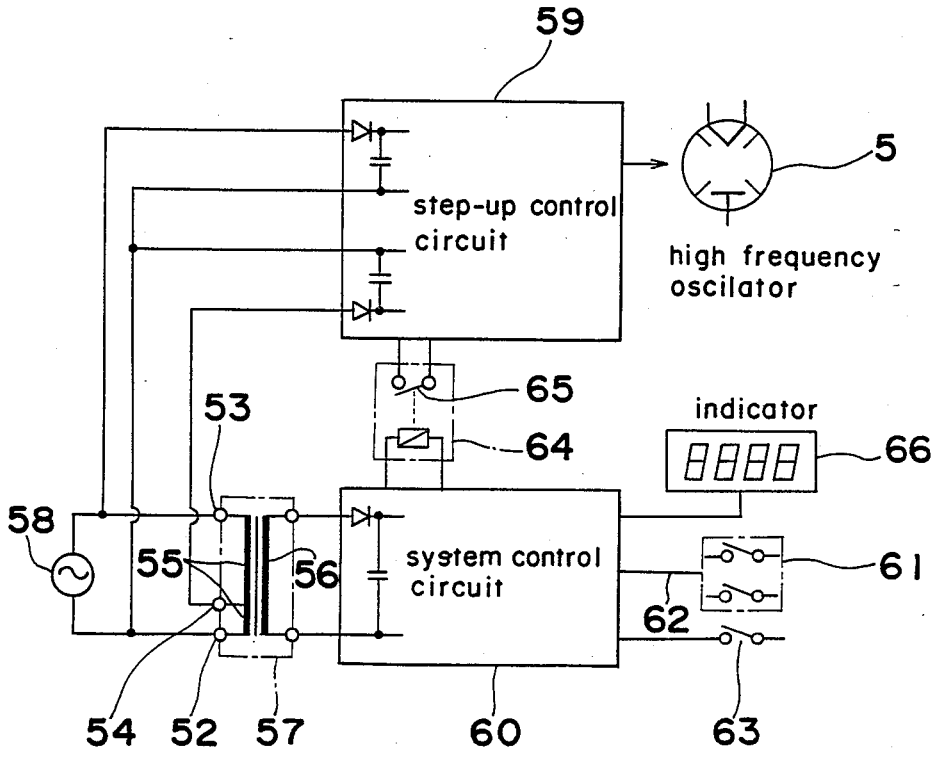
FIG. 6 is a circuit block diagram showing one embodiment of the low voltage power-supply construction in accordance with the present invention.

FIG. 6 shows the other embodiment showing the power supply construction between the inverter controlling circuit and the system controlling portion.

In FIG. 6, a commercial power supply 58 is applied between the first connecting terminal 52 and the second connecting terminal 53, of the low voltage transformer 57 having a primary winding 55, having the first connecting terminal 52, the second connecting terminal 53, the third connecting terminal 54 and the secondary winding 56. Between the first connecting terminal 52 and the third connecting terminal 54, the commercial power supply 58 is rectified, smoothed and boosted to apply the high voltage upon the high frequency oscillator 5. A boost controlling circuit 59 for controlling the feed power is connected to feed the circuit power. The secondary winding 56 is connected with the system controlling circuit 60 for controlling the operation of the whole apparatus to feed the circuit power.

An operation switch information signal 62 from the operation switch portion 61 of a cooking shaft switch, a cooking time setting switch, etc. and the information of the door opening and closing detection switch 63 of the high frequency heating apparatus are received. The system controlling circuit 60 drives the high tension on and off control contact point 65 of the relay 64 to control off the high voltage applied upon the high frequency oscillator 5. Also, at the same time, the cooking time, etc. are displayed on the display portion 66.

Figure 7:
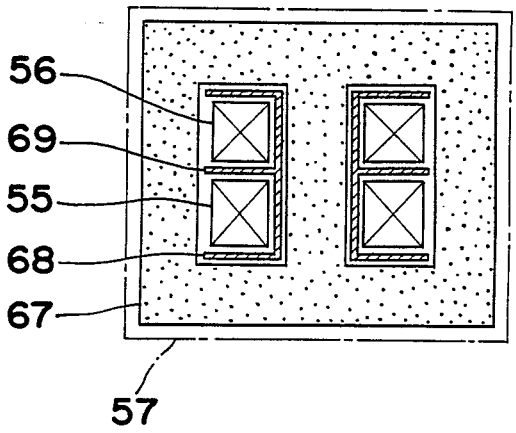
FIG. 7 is a cross sectional view of a portion in the other embodiment of the low voltage transformer in accordance with the present invention.

FIG. 7 is a cross-sectional view of the low voltage transformer 57. The insulation is provided between the primary winding 55 and the secondary winding 56 by the insulating portion 69 between the primary and the secondary of the bobbin 68 provided within the core 67 as shown.

Accordingly, the system controlling circuit 60 is insulated from the boost controlling circuit 59 by the insulation construction between the relay 64, and the primary and the secondary of the low tension transformer 57, and is insulated also from the commercial power supply 58.

Also, the insulation construction of the low voltage transformer 57 is not restricted to the system shown in FIG. 6, with the insulation being provided between both the circuits even in the system of insulating in between both the windings with the insulating paper through the superposing and winding operations of the primary and secondary windings.

Figure 8:
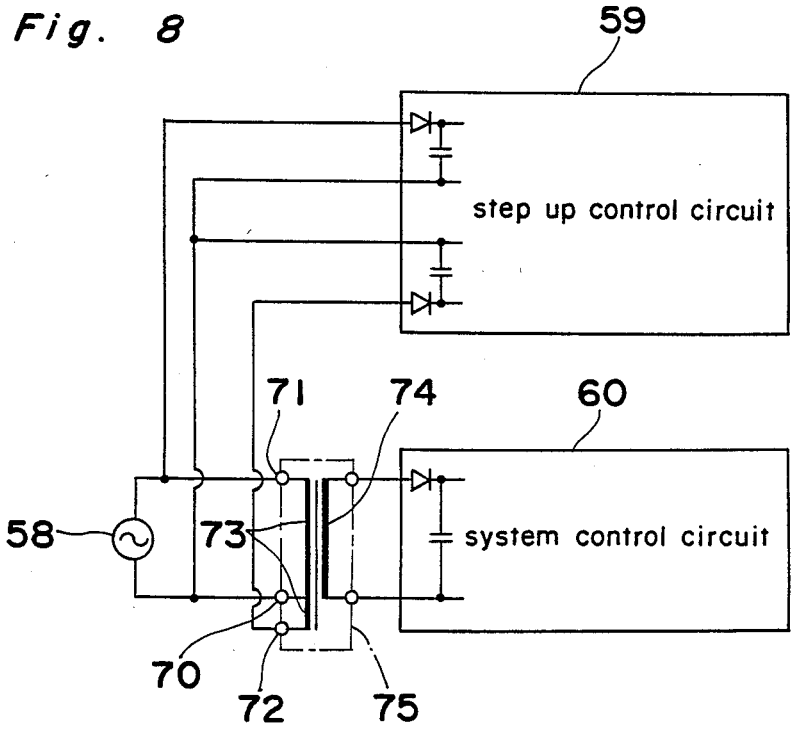
FIG. 8 illustrates a circuit block diagram showing another embodiment of the low voltage power-supply construction in accordance with the present invention.

FIG.8 is a diagram showing one portion of a circuit construction used in a high frequency heating apparatus in the second embodiment, wherein the connecting terminal of the primary winding is different in construction from that in the embodiment of FIG. 6.

As shown, the commercial power 58 is applied between the first connecting terminal 70 and the second connecting terminal 71 of a low tension transformer 75 having a primary winding 73, having the first connecting terminal 70, a second connecting terminal 71, a third connecting terminal 72, and a low voltage transformer 75 having a secondary winding 74. The circuit power is fed into the boost controlling circuit 59 from between the first connecting terminal 70 and the third connecting terminal 72, and the circuit power is fed into the system controlling circuit 60 from the secondary winding.

In the embodiment of FIG. 18, an operation similar to that in the embodiment of FIG. 6 is performed.

Figure 9:
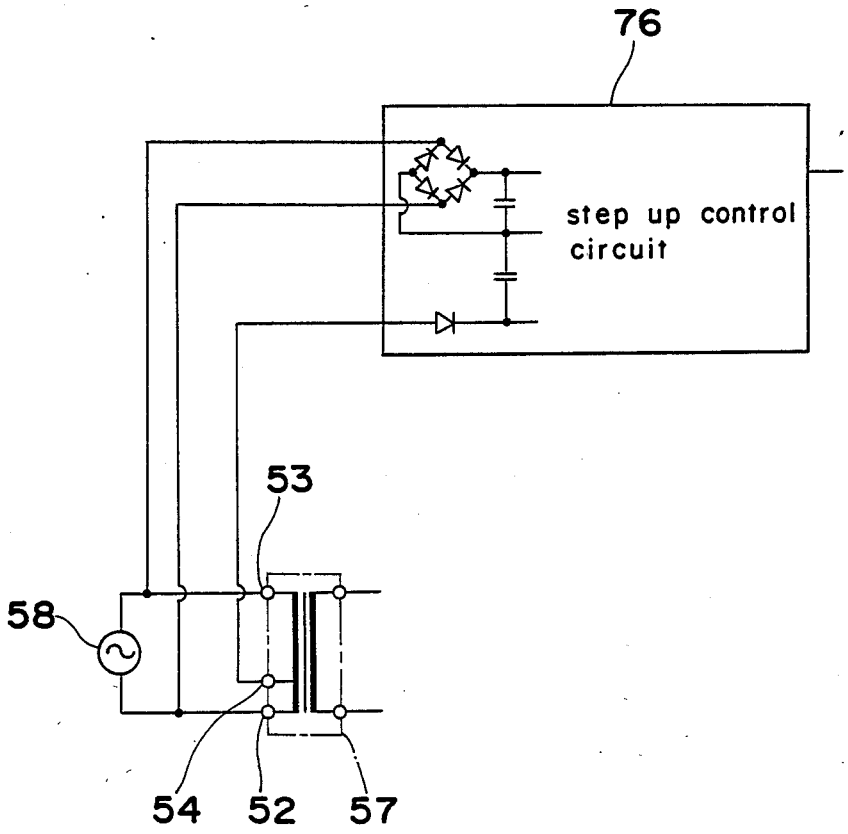
FIG. 9 illustrates a circuit block diagram showing the other embodiment of the low voltage power-supply construction in accordance with the present invention.

In the embodiment of FIG. 6, the commercial power supply 58 is rectified in half-wave to feed power into the high frequency oscillator 5, but in the partial circuit construction view in the other embodiment to be shown in FIG. 9, it is constructed of full-wave rectification, with the inside construction of the boost controlling circuit 76 being partially different. It can easily be understood that this is the reason why the commercial power supply 58 is not short-circuited.

As described hereinabove, in the present invention, one of the low voltage transformers may be reduced, thus resulting in reduced parts space, parts cost, while the insulation between the boost controlling circuit and the system controlling circuit is being ensured.

Also, the low voltage transformer shown in FIG. 4, FIG. 5, FIG. 6, FIG. 7 and FIG. 8 is explained in the transformer which is transformed in voltage in the commercial power supply frequency, and is clearly the same as the high frequency transformer by the switching power supply.

Figure 10:
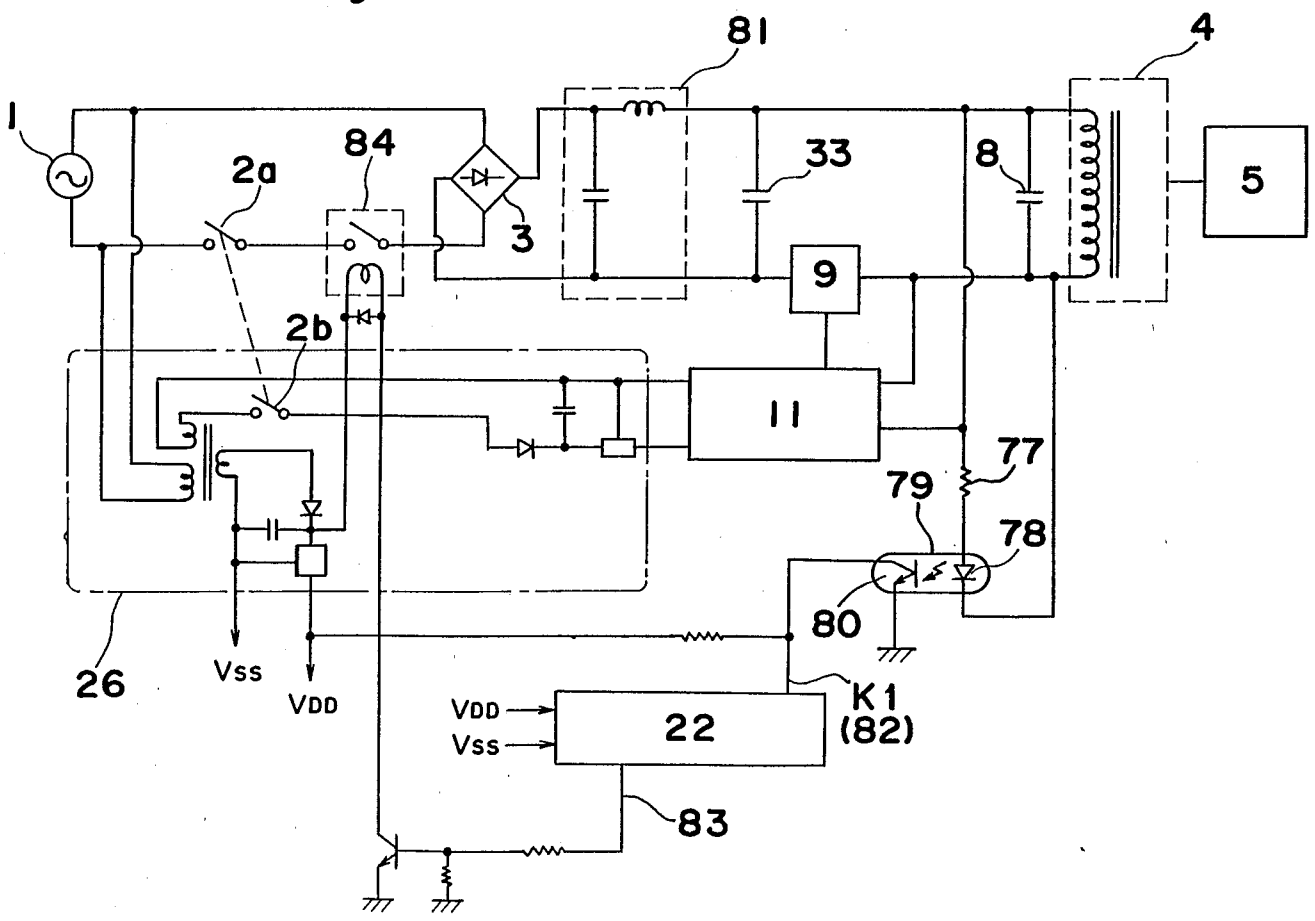
FIG. 10 is a circuit diagram of a high-frequency heating apparatus in the other embodiment of the present invention.

FIG. 10 shows a circuit diagram of an essential portion in the other embodiment of the present invention. The output of the rectifying circuit 3 is connected to the resonance capacitor through the filter circuit 81 and is also connected with a resistor 77 and a photodiode 78. The photodiode 78, together with the photo-transistor 80, constitutes a photocoupler 79. One end of the photo-transistor 80 is connected with one input terminal K1 (82) of the microcomputer 22. Under this construction, the contact point of the door switch **2*a* is closed with the door being closed, the output voltage between the rectification diode 3 and the smoothing capacitor 33 becomes approximately 142 V DC. This voltage is normally applied upon a series circuit of a high frequency transformer 4, a semiconductor switching element 9, a resistor 77 and a photodiode 78**.

When the door is opened, the contact point of the door switch **2*a* is opened to interrupt the power feeding operation to the DC power supply of the rectification diode 3 and the smoothing capacitor 8, so that the voltage of the DC power supply becomes 0 V after several tens of millisecond. As a result, the current to the photodiode 78** does not flow.

Changes in the current flowing to the photodiode 78 through the door opening or closing condition are detected by a photo-transistor 80 so as to input a "1" or "0" signal to the door signal input terminal K1 (82) of a microcomputer 22 for controlling the cooking operation.

A take-in decision processing procedure within the microcomputer 22 of such a door signal as hereinabove described will be described hereinafter.

Figure 11:
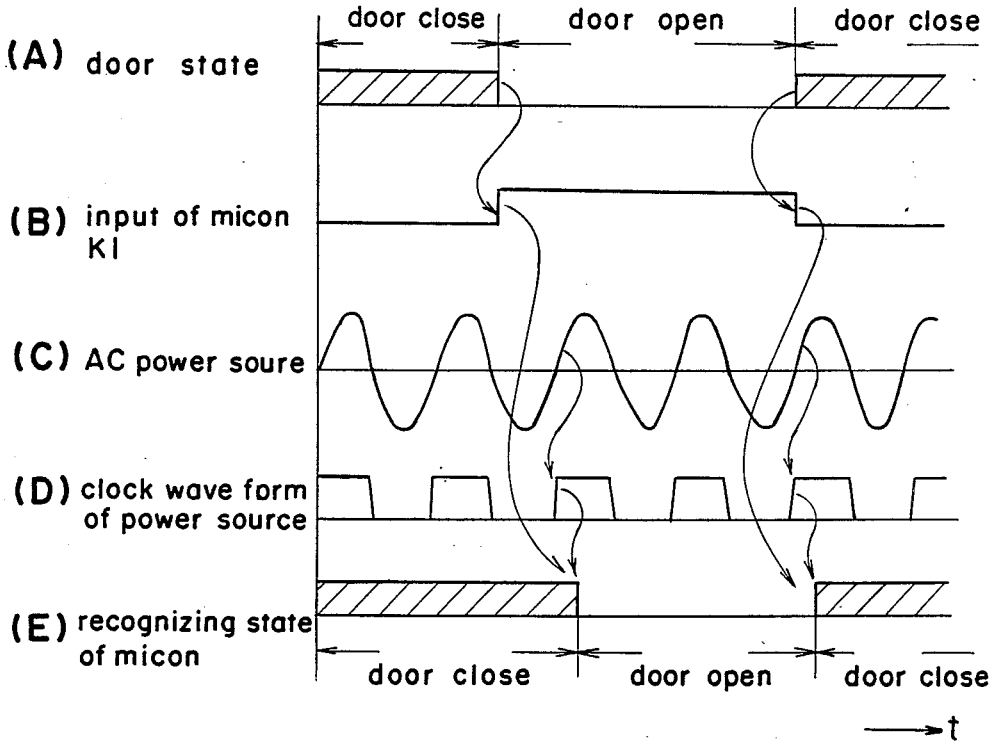
FIG. 11 is a timing chart in one embodiment of a door opening and closing signal detecting means in accordance with the present invention.
Figure 12:
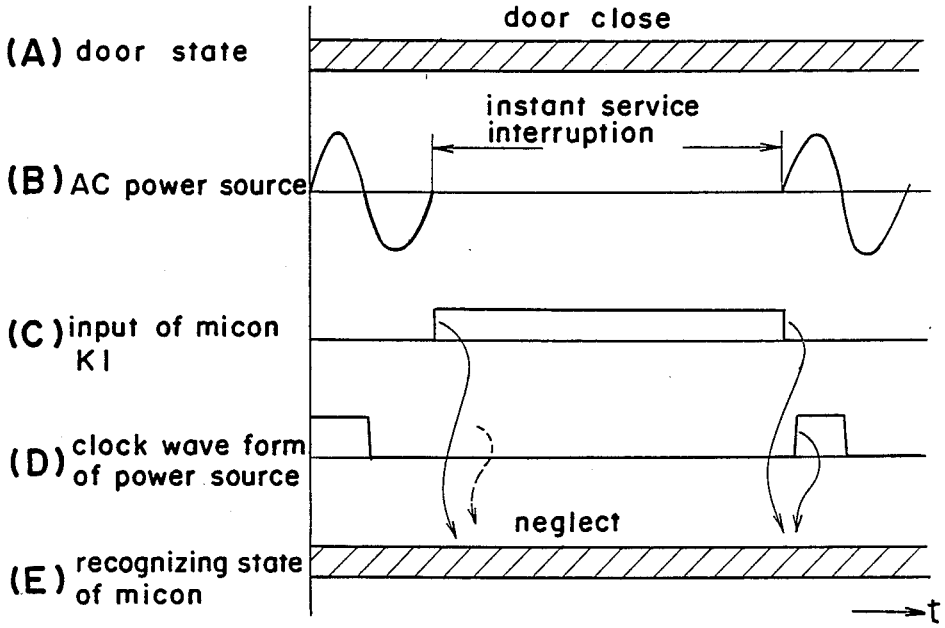
FIG. 12 is a timing chart similar to FIG. 11 but obtained under the other conditions thereof.

Referring to FIG. 11, the microcomputer K1 input B goes from an "L" (low) level to an "H" (high) level when the door condition A changes from close to open. The input signal is once latched into the microcomputer and waits for the rising timing of the power supply clock waveform D made of the AC power supply C for the processing in the program within the microcomputer, so that the recognizing condition E of the microcomputer goes to the open condition from the close condition.

The processing procedure is completely the same even when the door is closed after being open. The microcomputer K1 input signal B is once latched and is processed in synchronous relation with the rising of the power supply clock waveform D. Accordingly, when the inputs are provided because of the momentary power-off from the AC power supply B in spite of the door condition A closed, the microcomputer K1 input C goes to a level "H" (high) from a level "L" (low) with the door being closed, so that the conditions change as if the door is opened. However, as described hereinabove, this is a system of processing for the first time at the rising timing of the power supply clock waveform D, with the signal being once latched into the microcomputer, the recognizing condition E of the microcomputer remains closed unless the power supply clock is inputted because of the momentary power-off.

A system is provided of latching the signals once from the photo-transistor so as to process at the take-in timing of the power supply clock, so that the error action at the momentary power-off time may be removed.

Also, in the above description, the embodiment for processing with a program by the use of the microcomputer is described. Naturally, the construction may be made even in terms of the hardware by the use of sample-hold circuit and so on, instead of the microcomputer.

According to the present invention, the following effects are provided in the door signal taking-in construction of a high frequency heating apparatus provided with an inverter type high frequency power supply.

(1) Considering the fact that a constant voltage is applied upon one end of the high frequency transformer only at the door closure, but is not applied at the door opening, the changes are detected by the photo-transistor so as to serve as a door signal switch. Thus, the door signal switch is removed, thus resulting in considerable reduction in cost as to the whole heating apparatus.

(2) Since a door signal switch having a mechanical contact-point mechanism is removed, the operational characteristics of the opening and closing operations of the door is simplified, thus improving the value of the commodity.

(3) A system of effecting the processing operation through the synchronous operation of the processing of the photo-transistor output signals with the power-supply clock waveforms may improve the reliability and safety of the operation during the momentary stop.

Also, in the embodiment of FIG. 10, the door switch **2*b* is also adapted to selectively initiate and interrupt the supply of the power to the inverter controlling circuit 11**. This is a safety measure for cutting off the power supply by the door opening if anything goes wrong with the inverter controlling circuit.

A major circuit relay 84 to be driven by the output 83 of the microcomputer selectively opens and closes the major power supply circuit. Thus, the above description has the effect of preventing troubles caused by the faults of the inverter controlling circuit.

As is clear from the foregoing description, according to a high frequency heating apparatus using an inverter circuit as a boost power supply of the high frequency oscillator, the precise measurement of the power-off detection and the operation stop time may be effected, so that the semiconductor switching element may be easily protected. Also, insulation between a system controlling portion for controlling the operation switch and the inverter controlling circuit connected with the commercial power supply may be retained, thus resulting in extremely high safety. Furthermore, as the cut-off of the major power supply circuit and the opening and closing detection of the door in the system controlling portion may be effected by one door switch only, the price is lower and the operational characteristics are superior. In addition, the opening and closing means of the major power supply circuit is provided in the system controlling portion to improve the safety.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as included therein.

What is claimed is:

1. A high frequency heating apparatus comprising: a rectification power supply for feeding a DC current; a high frequency transformer connected with said rectification power supply; a resonance capacitor connected in parallel to the primary side of said high frequency transformer and to said rectification power supply; a semiconductor switching element connected between said high frequency transformer and said rectification power supply to supply said high frequency transformer with a high frequency current; an oscillation circuit for oscillating a constant oscillation frequency; a system controlling portion which counts the oscillation frequency of said oscillation circuit during a power off condition of the input or the output of said DC power supply and to generate a power-off detection output signal when said power-off condition has continued for at least a given time period; an inverter controlling circuit for generating a driving signal for activating and deactivating said semiconductor switching element and for performing a controlling operation to shorten the activation time of said semiconductor switching element when said power-off detection output signal has been outputted; a low voltage transformer composed of a first winding connection with an AC power supply, a second winding connected with said inverter controlling circuit and a third winding connected with said system controlling circuit.

2. A high frequency heating apparatus in accordance with claim 1, wherein the second winding of the low voltage transformer is formed of a portion of the first winding thereof, and the third winding is insulated electrically and physically from the first and second windings.

3. A high frequency heating apparatus in accordance with claim 1, wherein a barrier of an insulating material is provided between the first winding of said low voltage transformer and the third winding thereof.

4. A high frequency heating apparatus comprising: a rectification power supply for outputting a DC current; a high frequency transformer connected to said rectification power supply; a resonance capacitor connected in parallel to the primary side of said high frequency transformer and to said rectification power supply; a semiconductor switching element connected between said rectification power supply and said high frequency transformer for supply said high frequency transformer with a high frequency current of more than about 1 KHz; an oscillation circuit for oscillating at a constant oscillation frequency different from said frequency supplied by said semiconductor switching element; a system controlling portion for counting oscillations of said oscillation circuit during a power-off condition of either the input or the output of said DC power supply and for generating a power-off detection output signal when said power-off condition has continued for at least a given period of time; and, an inverter controlling circuit for generating a driving signal for activating said semiconductor switching element and for performing a controlling operation to shorten an activation time of said semiconductor switching element in response to said power-off detection output signal.

5. A high frequency heating apparatus in accordance with claim 4, wherein said system controlling portion includes a microcomputer for sequentially executing instructions stored therein and synchronized with said oscillation circuit.

6. A high frequency heating apparatus in accordance with claim 4, wherein a coupling means for coupling the power-off detection output is provided between the system controlling portion and the inverter controlling circuit, the coupling means being composed of a photocoupler.

7. A high frequency heating apparatus comprising a rectification power supply for feeding a DC current, a high frequency transformer and a semiconductor switching element connected with the output of the rectification power supply, a door switch which operatively cooperates with the opening and closing of the door of a heating chamber to cut off the output of the rectification power supply when the door has been opened, a door opening and closing detection means for detecting the presence or absence of the output of the rectification power supply to detect the opening and closing of the door switch.

8. A high frequency heating apparatus comprising: an inverter circuit composed of a rectification power supply for feeding a DC current; a high frequency transformer connected with said rectification power supply and a semiconductor switching element; an inverter controlling circuit for controlling the activation and deactivation of the semiconductor switching element; a low voltage power supply portion for feeding a low voltage power supply to said inverter controlling circuit; and operation switch for allowing a user to indicate starting of the apparatus; a system controlling portion for controlling a load switching means, said load switching means being adapted to switch on and off an output voltage of at least one of said low voltage power supply and said rectification power supply in accordance with an indication of said operation switch.

* * * * *